US009402456B2

(12) United States Patent
Shtriker

(10) Patent No.: US 9,402,456 B2
(45) Date of Patent: Aug. 2, 2016

(54) DEVICE FOR DISTRIBUTING WEIGHT

(75) Inventor: Yehonatan Shtriker, Kibbutz Mizra (IL)

(73) Assignee: MAROM DOLPHIN LTD., Afula (IL)

( * ) Notice: Subject to any disclaimer, the term of this patent is extended or adjusted under 35 U.S.C. 154(b) by 699 days.

(21) Appl. No.: 13/212,671

(22) Filed: Aug. 18, 2011

(65) Prior Publication Data

US 2012/0043361 A1 Feb. 23, 2012

(30) Foreign Application Priority Data

Aug. 22, 2010 (IL) ..... 207744

(51) Int. Cl.
*A45F 3/04* (2006.01)
*A45F 3/08* (2006.01)
*A45F 3/10* (2006.01)

(52) U.S. Cl.
CPC . *A45F 3/047* (2013.01); *A45F 3/08* (2013.01); *A45F 3/10* (2013.01)

(58) Field of Classification Search
CPC ..... A45F 3/047; A45F 3/08; A45F 3/10; A45F 2003/144; A45F 2003/045; A45F 2003/125; A45F 2003/122; A45F 2003/127; A45F 4/02; A45F 3/04; A47D 13/025; B63C 2011/026; A62B 9/04; A62B 25/00
USPC ..... 224/262, 628, 259, 261, 263, 631, 633, 224/634, 635, 636, 637, 575, 576, 153, 908, 224/646; 2/462, 102, 95, 913
See application file for complete search history.

(56) References Cited

U.S. PATENT DOCUMENTS

| | | | | |
|---|---|---|---|---|
| 3,889,859 | A | 6/1975 | Joseph | |
| 4,830,245 | A | 5/1989 | Arakaki | |
| 5,562,513 | A * | 10/1996 | Kaiser | 441/111 |
| 5,878,928 | A * | 3/1999 | Seiber | 224/153 |
| 6,199,732 | B1 * | 3/2001 | Swetish | 224/262 |
| 6,536,641 | B1 | 3/2003 | Sundara | |
| 2005/0082330 | A1 | 4/2005 | Fehlberg et al. | |

FOREIGN PATENT DOCUMENTS

| | | | |
|---|---|---|---|
| AU | 720273 | B2 | 5/2000 |
| DE | 3918346 | A1 | 12/1990 |

* cited by examiner

*Primary Examiner* — Adam Waggenspack
*Assistant Examiner* — Matthew Theis
(74) *Attorney, Agent, or Firm* — Browdy and Neimark, PLLC

(57) ABSTRACT

A bridging device for securing a load carried by a user over a vest having interior side facing the user and exterior side facing away from the user that comprises a first axle capable of being coupled to the load in an area proximal to the exterior side, a second axle capable of being coupled to a support element worn by the user in an area proximal to the interior side; and at least one connecting element connecting the first axle to the second axle, wherein the connecting element is capable of maintaining a tension between the load and the support element.

15 Claims, 23 Drawing Sheets

DEVICE FOR DISTRIBUTING WEIGHT

FIELD OF THE INVENTION

The present invention relates to systems for carrying loads. In particular the invention relates to support systems for carrying loads worn on top of a layer of gear.

This present application claims the benefit of an earlier IL patent application S.N. 207744 filed on Aug. 22, 2010 by Marom Dolphin Ltd. and entitled "Device for Distributing Weight."

BACKGROUND

Bullet resistant vests are an item of personal armor that helps absorb the impact created by projectiles shot from firearms and shrapnel created by explosive materials. Bulletproof vests are worn on a torso of an individual, thus assisting in the prevention of injuries to essential body parts, and have become essential gear for the everyday operation of security personnel such as combat soldiers, police tactical units, hostage rescue teams and the like.

Vests are typically made of many layers of woven or laminated fibers, and may be combined with metal or ceramic plates for additional protection. Due to the layered structure of the vests, they are heavier and thicker than ordinary clothing items worn about the torso.

It is common for security personnel wearing a bullet-resistant vest to have to carry gear on their backs. The gear may be stored in a backpack and harnessed on the person's back using straps, belts, or the like.

Backpacks and harnesses are often combined with support elements aimed towards reduction of forces or pressure acting on the spinal cord or towards affecting intra-abdominal pressure caused by lifting heavy loads. Support elements typically comprise a lumbar belt worn around the waist. The lumbar belt couples the load to a user's hips, thus relieving some of the weight of the load carried upon the user's back and shoulders.

Harnessing a load on top of other gear such as a bullet resistant vest creates pressure upon a person's back. The lumbar belt may become ineffective when harnessed upon a person also wearing a bullet-resistant vest. The thickness and form of a vest might create a gap between the person's torso and the vest, thus preventing the lumbar belt from binding properly to the person's waist and eliminating the intended beneficial effect of the support elements.

US Patent application No. US2005082330 to Fehlberg Eric et al titled "Pack support with frictional load transfer" discloses a wearable load supporting system used to shift weight from the shoulders to the waist by relying on frictional engagement between two stiff structures. One of the structures may be incorporated within a ballistic vest.

U.S. Pat. No. 4,830,245 to Arakaki Steven titled "Backpack carrier and shield" discloses a backpack carrier essentially made of Kevlar wrapped in layers over a light metal frame and capable of becoming a built-in bulletproof shield. The carrier does not include or interact with a lumbar belt, and is not targeted towards shifting weight from the shoulders and upper back of a user to his waist or lower back.

The need remains therefore, for an effective, versatile and simple back support system for people wearing standard bullet resistant vests and such like layers of gear. Embodiments described hereinbelow address this need.

SUMMARY OF THE EMBODIMENTS

According to one aspect, a bridging device for securing a load carried by a user over a vest having at least one interior side facing the user and at least one exterior side facing away from the user is provided, the bridging device comprising a first axle capable of being coupled to the load in an area proximal to the exterior side, a second axle capable of being coupled to a support element worn by the user in an area proximal to the interior side, and at least one connecting element connecting the first axle to the second axle, wherein at least one connecting element is capable of maintaining a tension between the load and the support element.

In preferred embodiments, the bridging device is configured to enable the insertion of at least part of the support element between the user and the interior side.

Optionally, the bridging device further comprises a plate having an end coupled to the second axle wherein the plate is capable of being coupled to a support element.

Optionally, the bridging device further comprises a locking mechanism capable of coupling the first axle to the second axle.

Preferably, the support element is capable of being fastened to at least part of a torso of the user.

The support element may be selected from a group comprising belts, straps, bands, and combinations thereof.

In some embodiments, the bridging device is configured to retrofit with a support element. Optionally, or in other embodiments, the bridging device is configured to retrofit with the load. Optionally, or in yet other embodiments, the bridging device is configured to retrofit with a harness capable of receiving the load.

In alternative embodiments, the bridging device is integrated with the support element. Optionally, or in other embodiments, the first axle is capable of coupled to a harness wherein the harness is capable of receiving the load. Optionally, or in yet other embodiments, the bridging device is integrated with a harness capable of receiving the load.

Some embodiments described herein further provide a harness for coupling with a bridging device comprising coupling utilities. Optionally, the coupling utilities may be selected from a group comprising pins, magnets, buttons, ropes, apertures, snap fits, and combinations thereof.

Some embodiments described herein further comprise a support element for coupling with a bridging device comprising coupling utilities. Optionally, the coupling utilities may be selected from a group comprising pins, magnets, buttons, ropes, apertures, snap fits, and combinations thereof.

According to another aspect, a method is disclosed for securing a load carried by a user over a vest having at least one interior side facing the user and at least one exterior side facing away from the user, comprising providing a bridging device comprising a first axle, a second axle and at least one connecting element connecting the first axle to the second axle, coupling the first axle to the load, coupling the second axle with a support element, placing at least part of the support element between the user and the interior side of the vest, and securing the load to the exterior side of the vest.

In some preferred embodiments, securing the load to the exterior side of the vest comprises fastening the support element around the user's torso. Optionally, coupling the first axle to the load comprises providing a harness capable of receiving the load, coupling the load to the harness, and coupling the first axle to the harness.

BRIEF DESCRIPTION OF THE FIGURES

For a better understanding of the invention and to show how it may be carried into effect, reference will now be made, purely by way of example, to the accompanying drawings.

With specific reference now to the drawing in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawing making apparent to those skilled in the art how the several forms of the invention may be embodied in practice.

In the accompanying drawings:

FIG. 1A is a view of an interior side of a prior-art harness;

FIG. 1B is a view of an interior side of a prior-art harness coupled with a load;

FIGS. 2A, 2B are a front view and a side view respectively of a person carrying a load using a prior-art harness;

FIGS. 3A, 3B are a front view and a back view of a lumbar belt;

FIG. 4A, 4B are a front view and a side view respectively of a person wearing a thick bullet resistant vest;

FIG. 5A, 5B are a side view and a close-up side view respectively of a user carrying a load assembled on a prior art harness over a bullet resistant vest;

FIG. 6A, 6B are perspectives views of embodiments of a bridging device;

FIG. 7 shows an embodiment of a bridging device coupled with a harness and a lumbar belt;

Figure 6A:
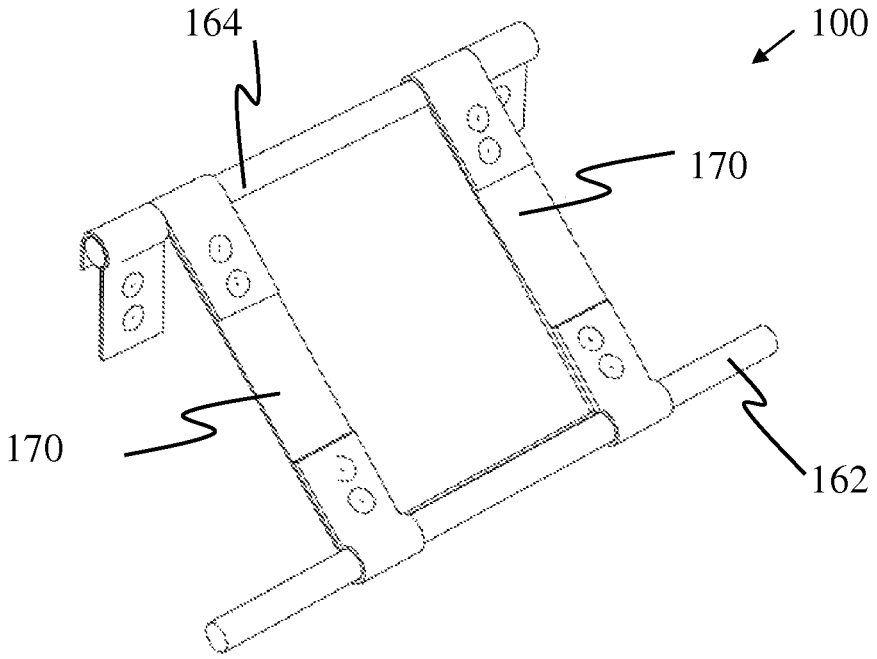
Figure 6B:
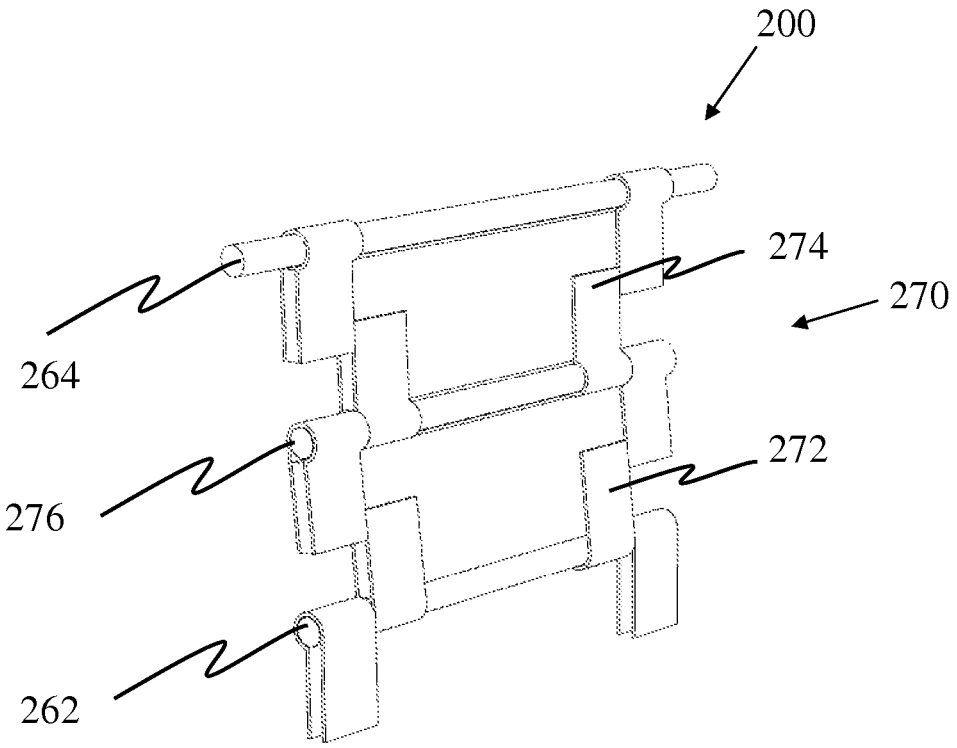
Figure 8:
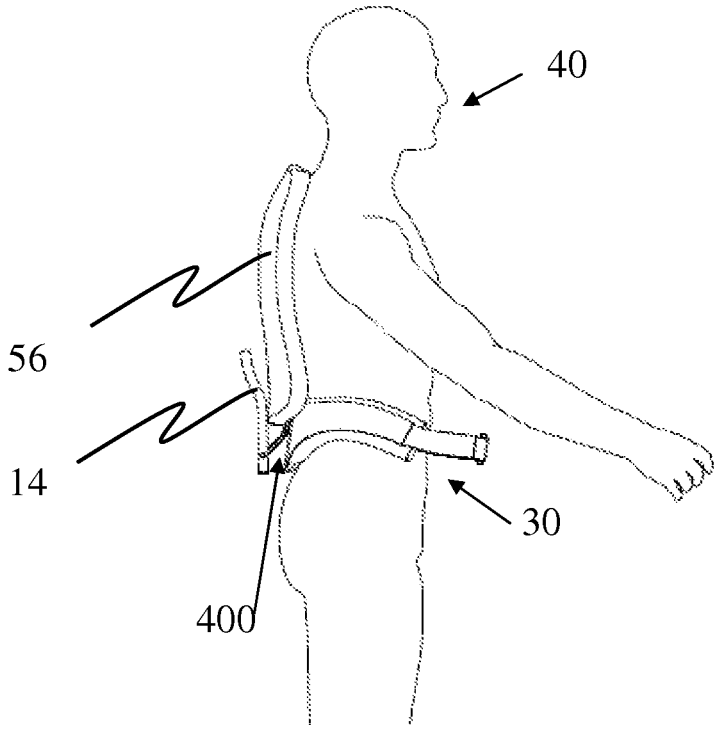
Figure 9A:
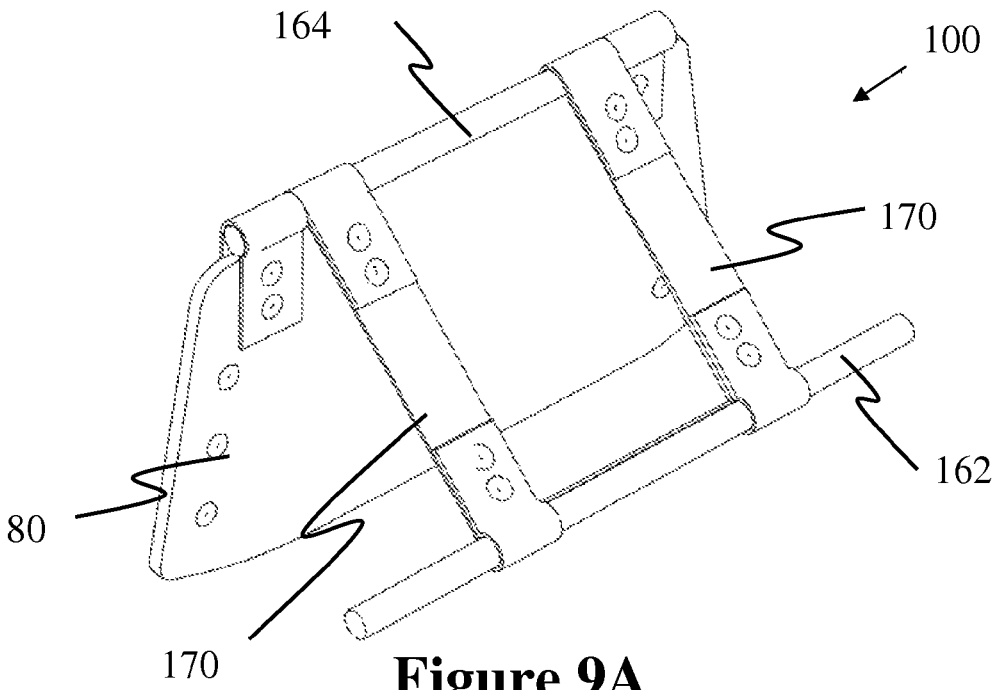
Figure 9B:
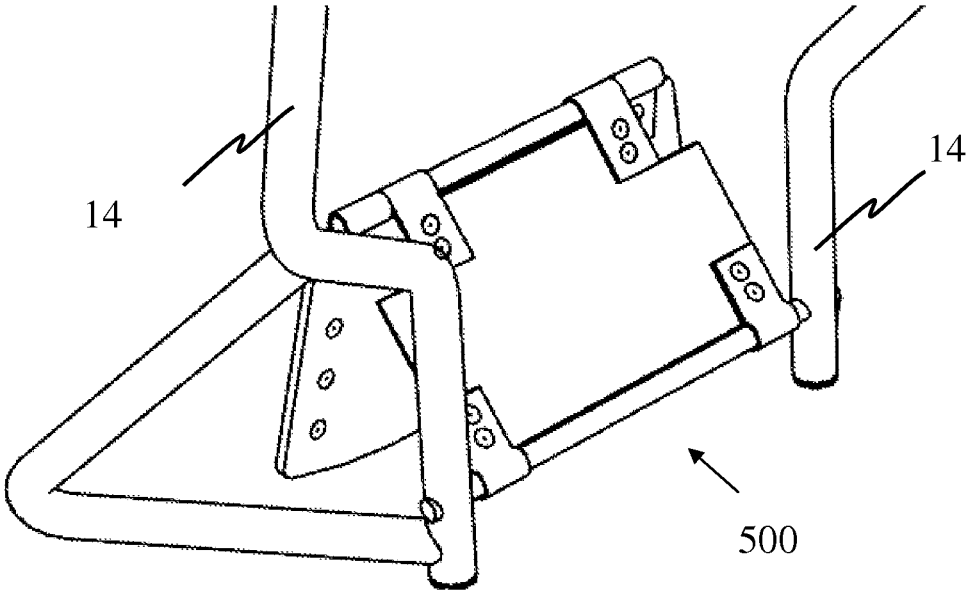
Figure 10A:
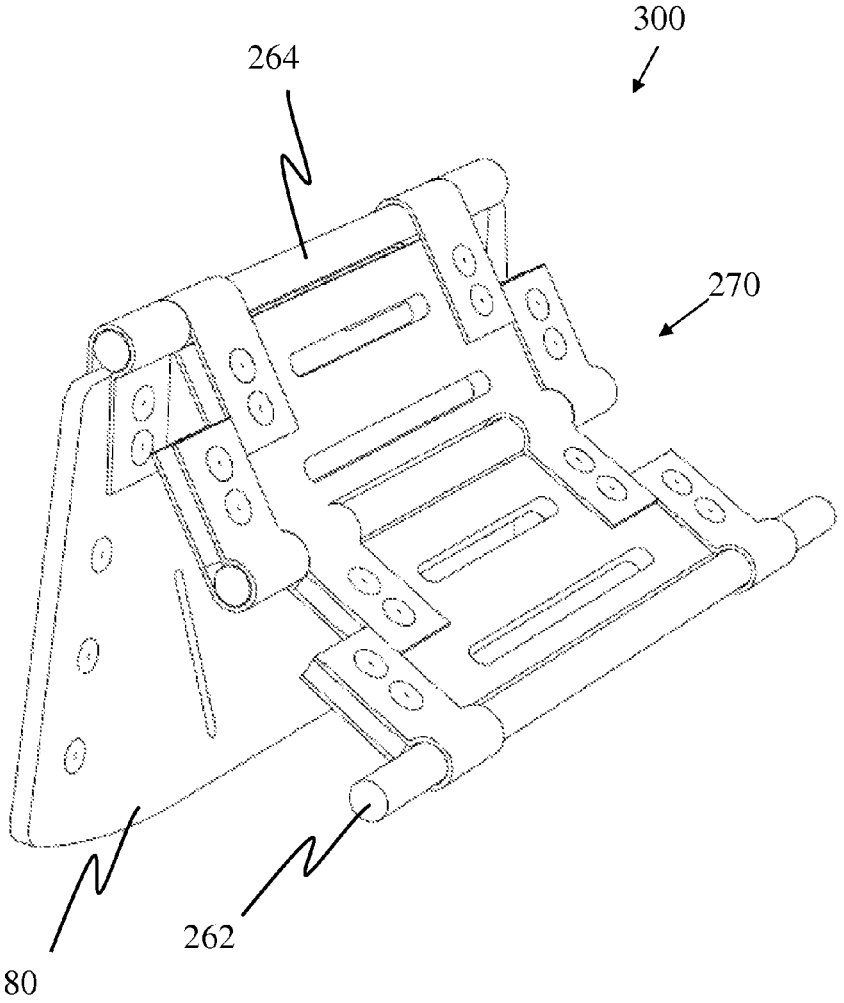
Figure 10B:
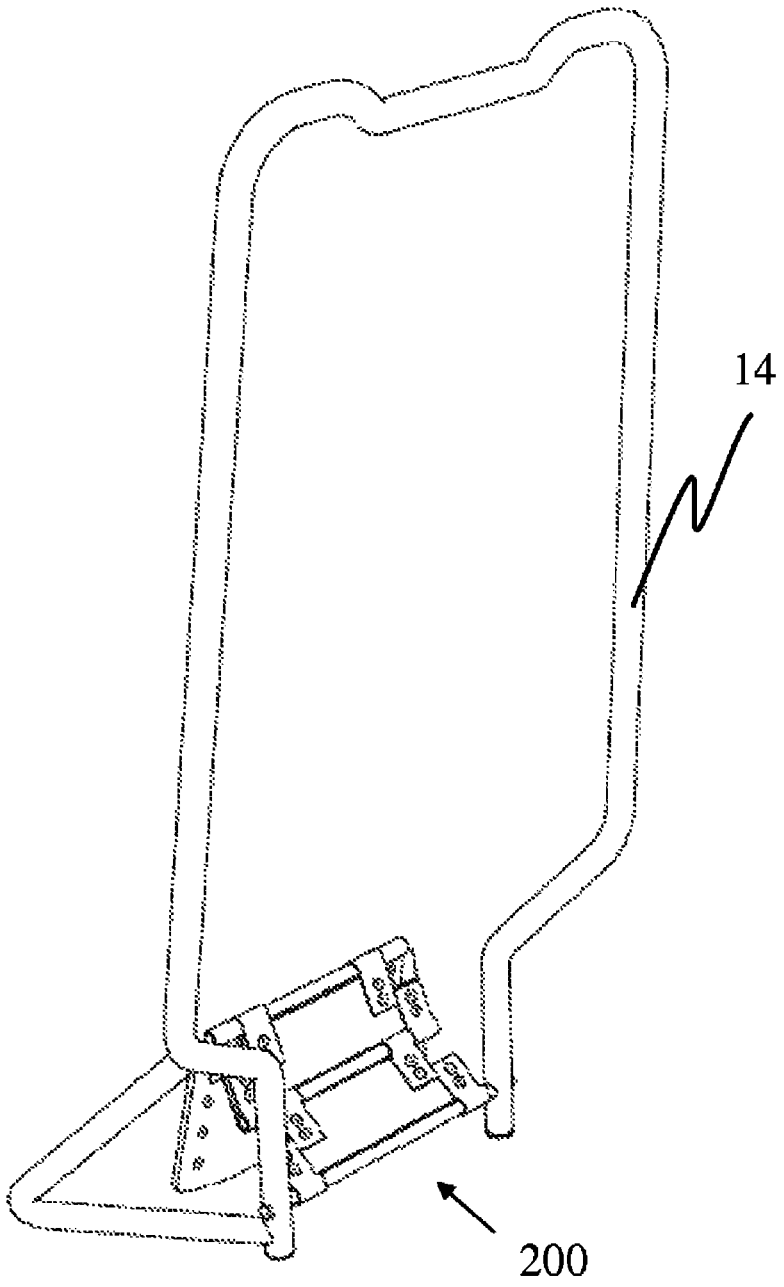
Figure 11A:
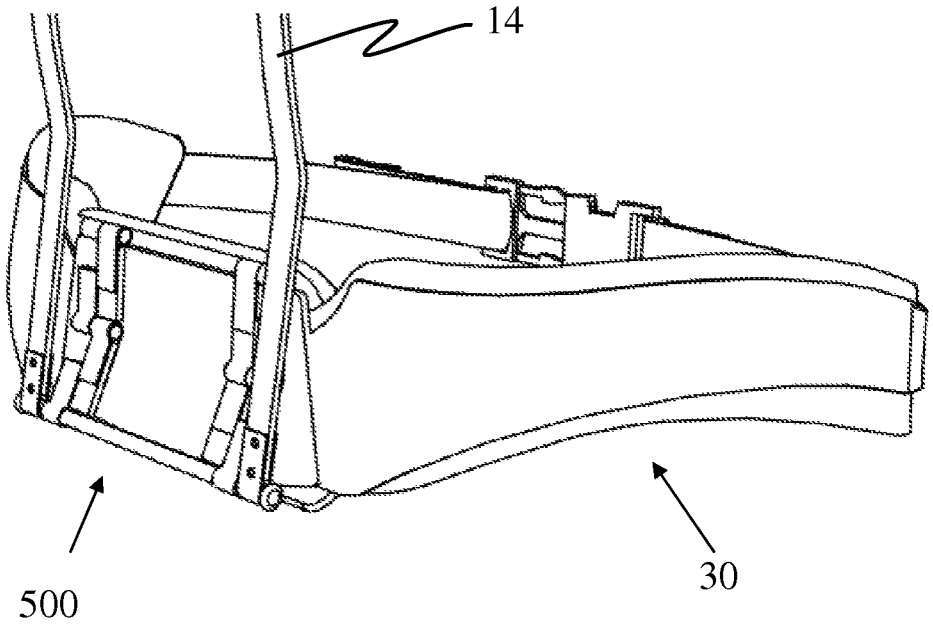
Figure 11B:
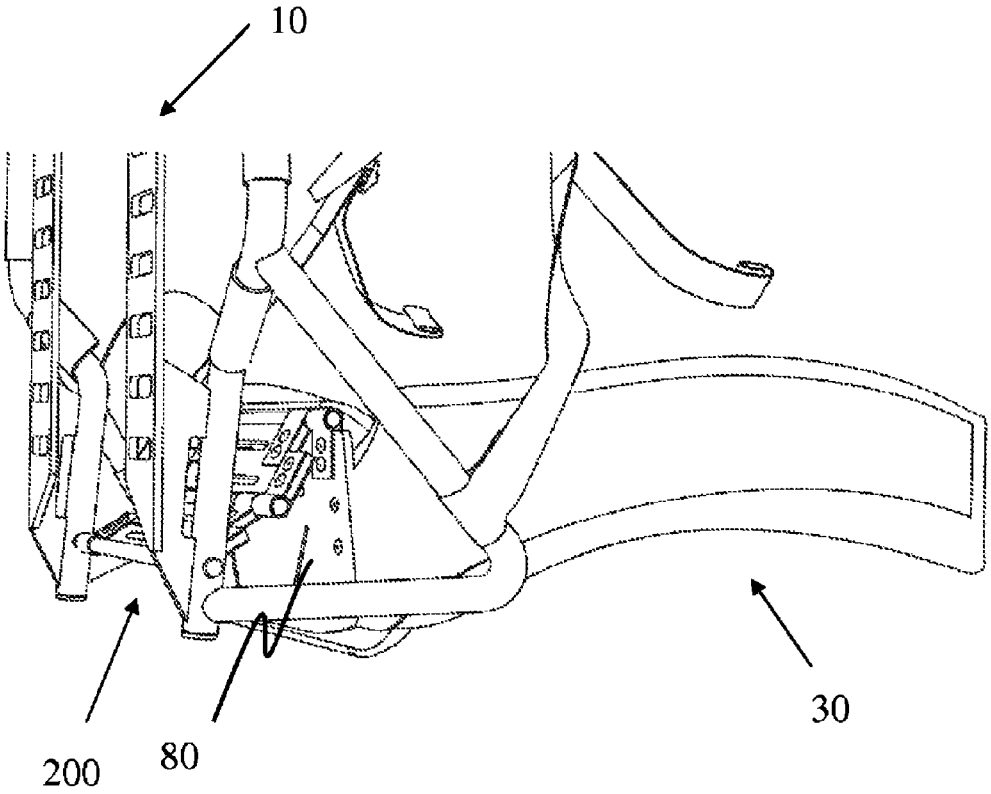
Figure 12:
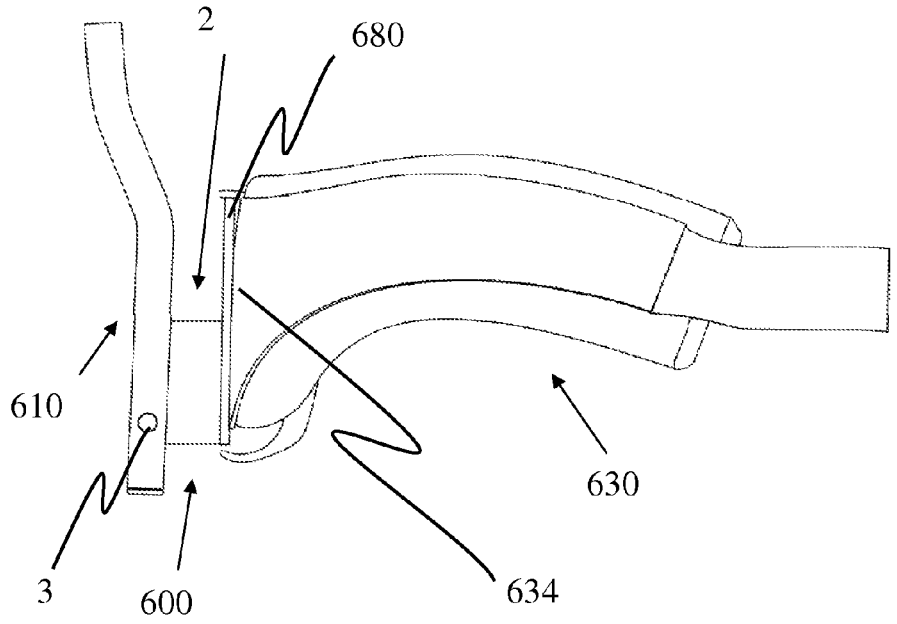
Figure 13:
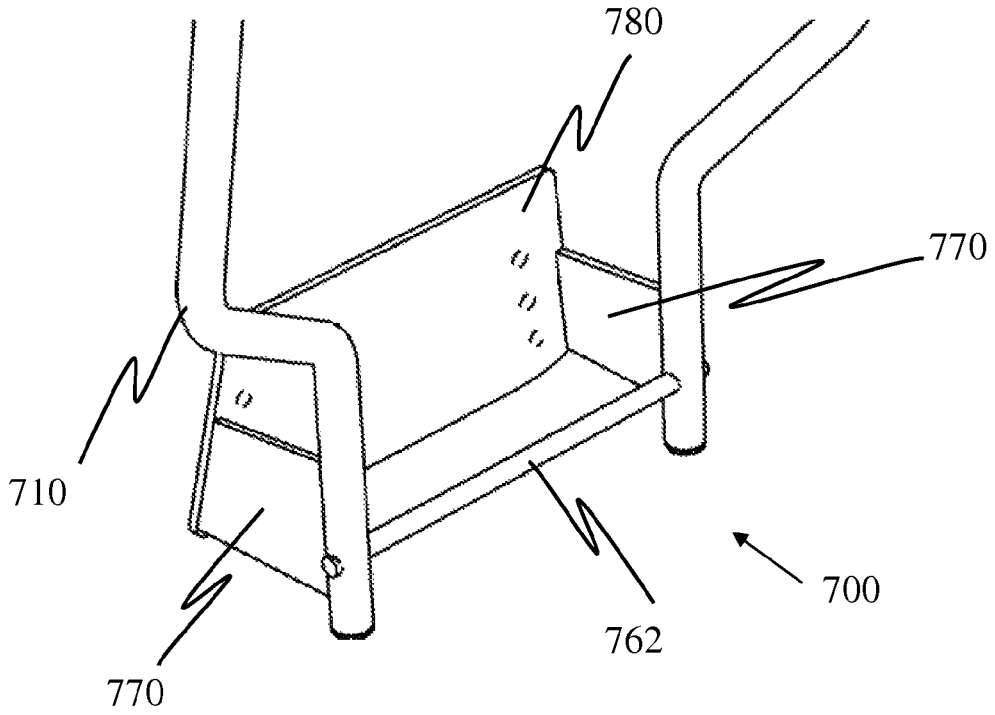

FIG. 8 schematically demonstrates usage of a bridging device embodiment for distributing weight;

FIG. 9A illustrates the bridging device embodiment shown in FIG. 6A, coupled with a plate;

FIG. 9B illustrates a coupling of another bridging device embodiment to a frame of a harness;

FIG. 10A illustrates an embodiment of a bridging device coupled with a plate;

FIG. 10B illustrates coupling the embodiment shown in FIG. 6B to a frame of a harness;

FIG. 11A illustrates a bridging device coupled to a lumbar belt wherein the coupling comprises inserting a plate into the lumbar belt;

FIG. 11B illustrates coupling a bridging device to a lumbar belt on one end and to a frame of a harness on the other end;

FIG. 12 illustrates an embodiment of a bridging device integrated with a harness and a lumbar belt;

FIG. 13 illustrates an embodiment of a bridging device having a plate and connecting elements made of rigid materials.

Figure 14:
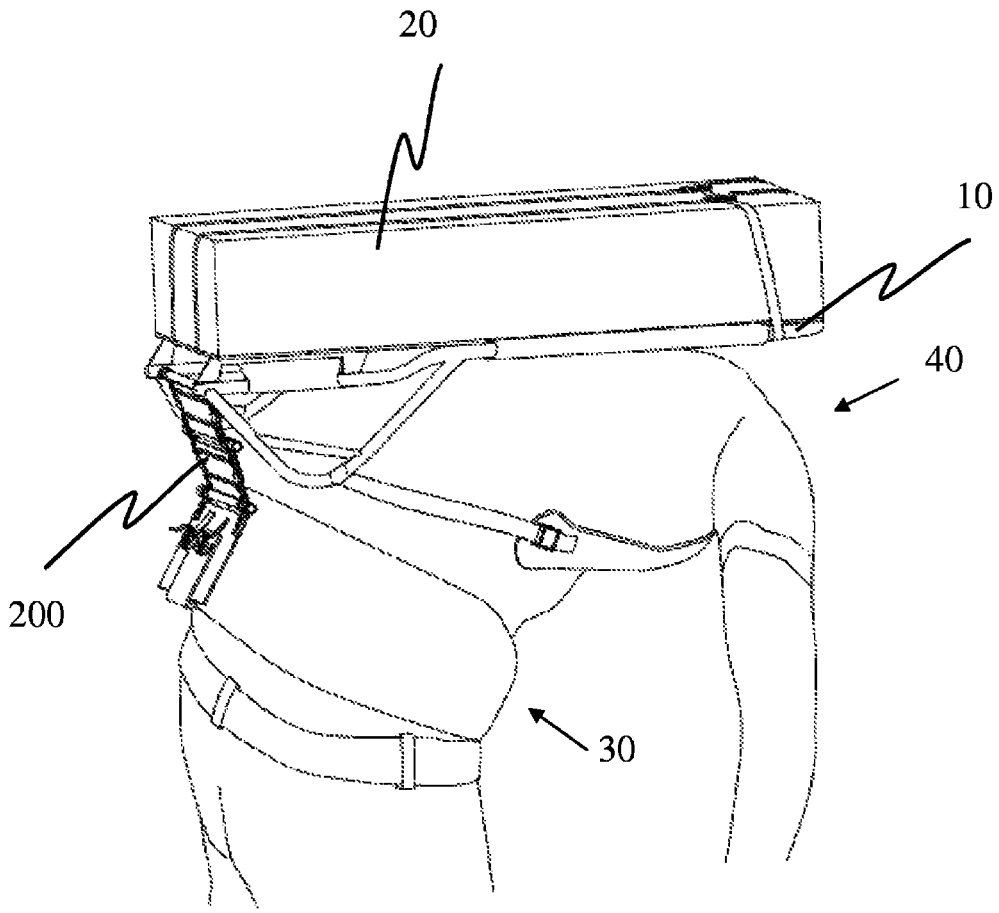

FIG. 14 demonstrates usage of a bridging device embodiment for distributing weight by a person bending forward.

DETAILED DESCRIPTION OF SELECTED EMBODIMENTS

Various embodiments of a bridging device for carrying heavy loads over a vest are disclosed hereinbelow.

The bridging device is configured to be used by a person wearing a heavy load such as a loaded backpack over a thick vest, typically a bulletproof vest. The term "vest" as will be used hereinbelow should not be looked at as limiting, and in general refers to a layer placed upon a user, optionally worn upon a user's torso. The layer may be for example and without limitation a layer of garments, bullet resistant vests, communication gear, carry-on bags, water bags, or such like garments configured to attach to a user. A vest may be worn over or attached to clothing articles. Alternatively, a vest may be attached to a user directly against the user's skin. A vest may attach to a user's front and/or a user's back.

The bridging device coupled to a harnessed load, for example a load carried within a backpack, enables the weight of the load to be distributed across a user's body via support elements such as a lumbar belt which provides the load with support by the hips. The bridging device coupled to a harness such as a backpack on one end and to a support element such as a lumbar belt on the other end may further enable a user to bend comfortably despite the cumbersome presence of a thick or heavy vest such as but not limited to a bullet-resistant vest.

The term "harness" used herein refers to various systems used for supporting a load upon a user, for example supporting a load upon a user's front or back, and should not be looked at as limiting. Harness examples may be backpacks, back support systems, or any other instrument or construct targeted towards carrying loads upon a user.

The term "support element" used herein refers to various systems configured to attach to a user's body and assist in supporting a load upon a user. Support elements may be for example belts, straps, ropes or the like. Attaching a support element to a user's body may be performed for example and without limitation by wrapping the support element around at least part of a user's torso. Additionally and alternatively, support elements may have different forms and structures and may be configured to be fastened to different body parts of a user such as but not limited to the user's legs, arms, or the like.

Prior Art Back Support Systems

Figure 1A:
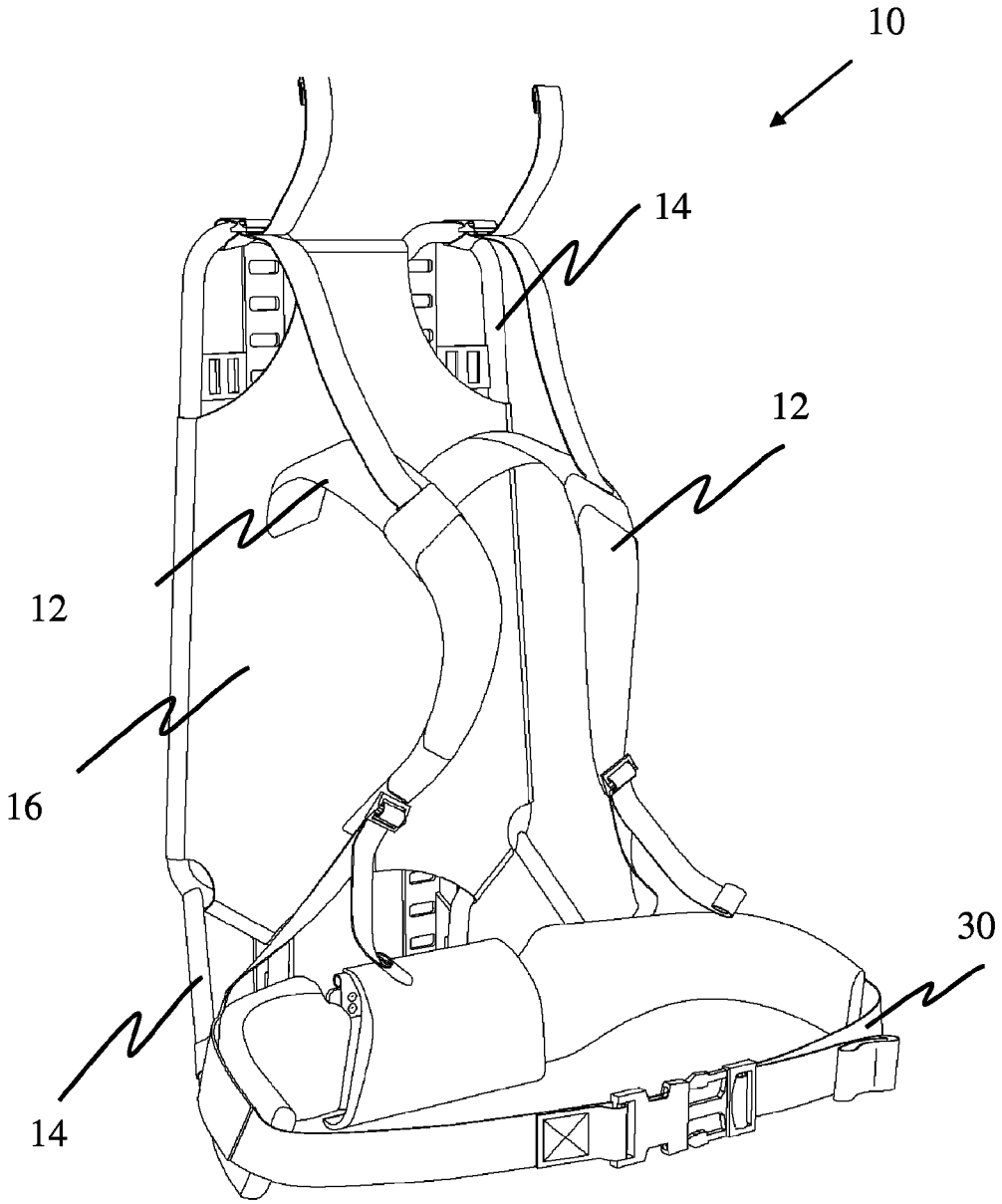
PRIOR ART Figure 1A
Figure 1B:
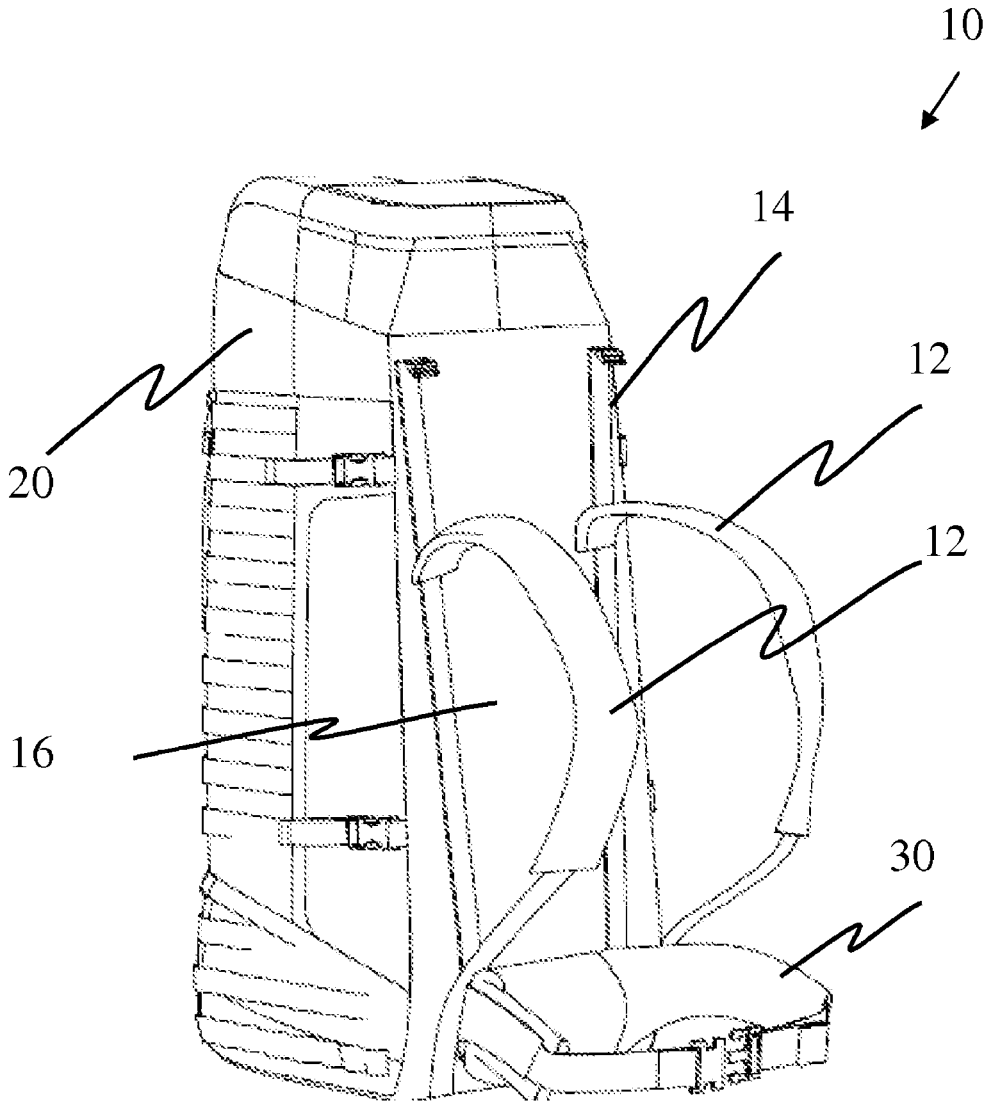
PRIOR ART Figure 1B
Figure 2A:
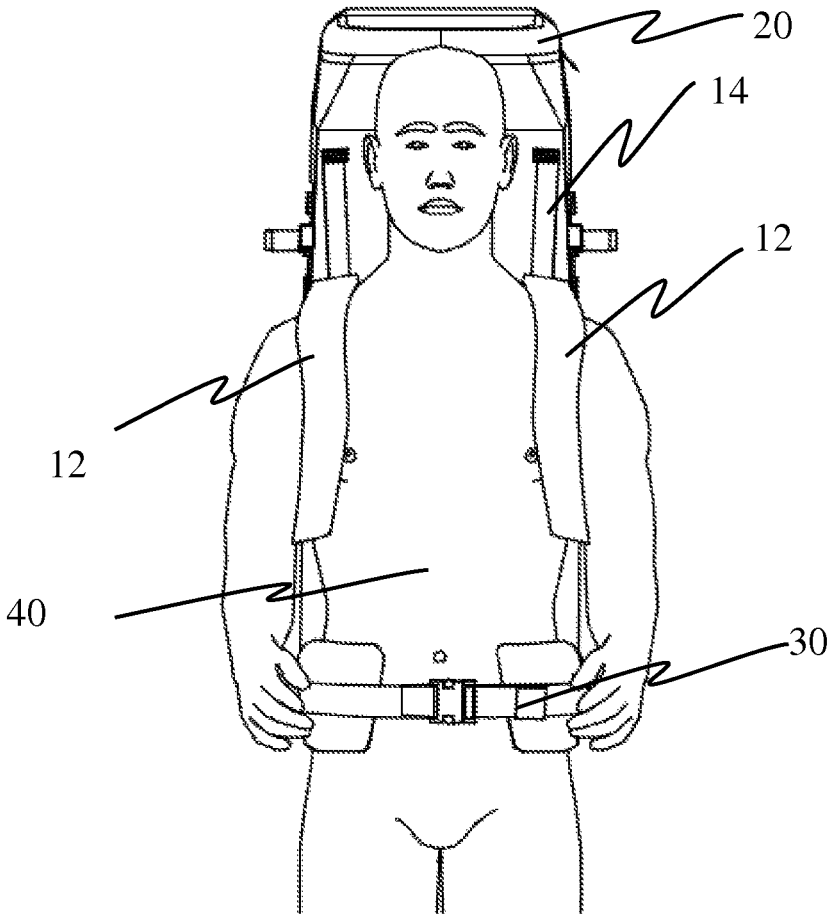
PRIOR ART Figure 2A
Figure 2B:
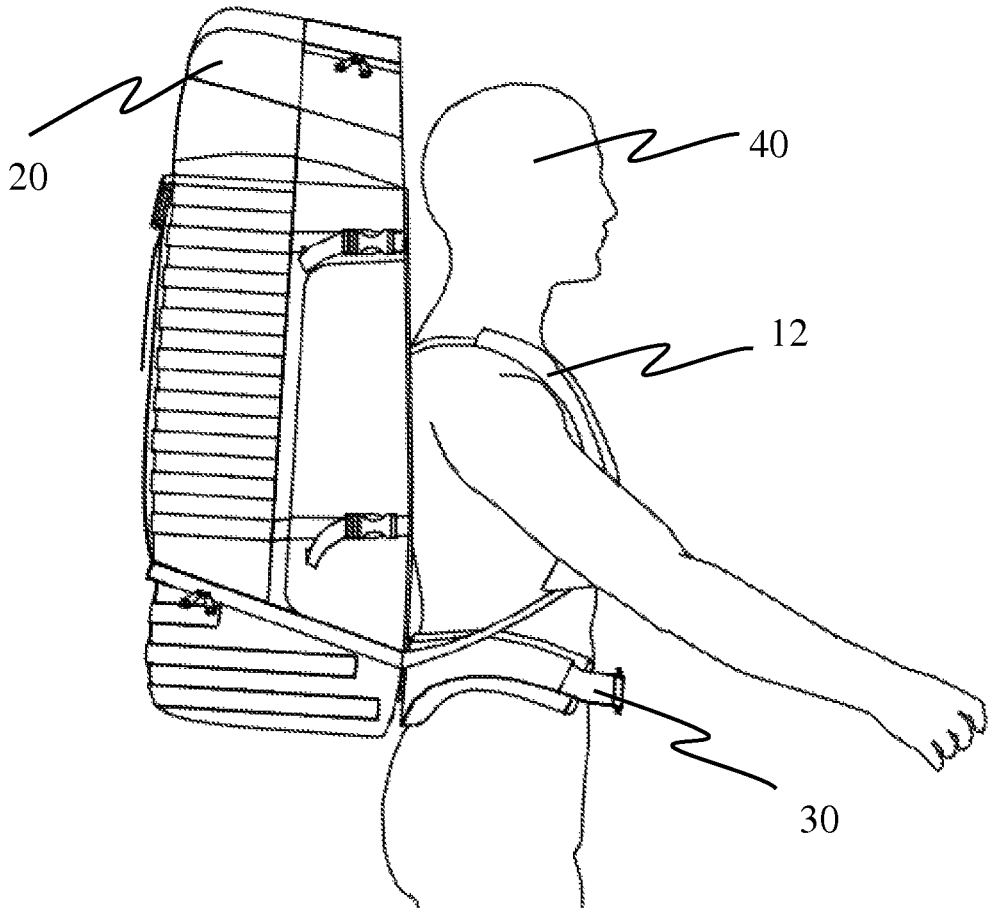
PRIOR ART Figure 2B

Reference is now made to FIG. 1A showing a view of an interior side of a prior-art harness 10 comprising two shoulder straps 12, a rigid frame 14, a back-surface 16 and a lumbar belt 30. FIG. 1B shows a view of an interior side of a prior-art harness 10' wherein the back surface 16' is coupled with a load 20. The interior side of a harness is configured to be harnessed upon a back of a person, such that the lumbar belt 30 and the shoulder straps 12 are used to attach the back-surface 16 to a user's back, as shown in FIG. 2A. When the side of the back surface 16 facing the user 40 is attached to a user's back as shown in FIG. 2B, the harness 10 contributes to weight distribution of the load 20 carried on the back of the user 40.

Figure 3A:
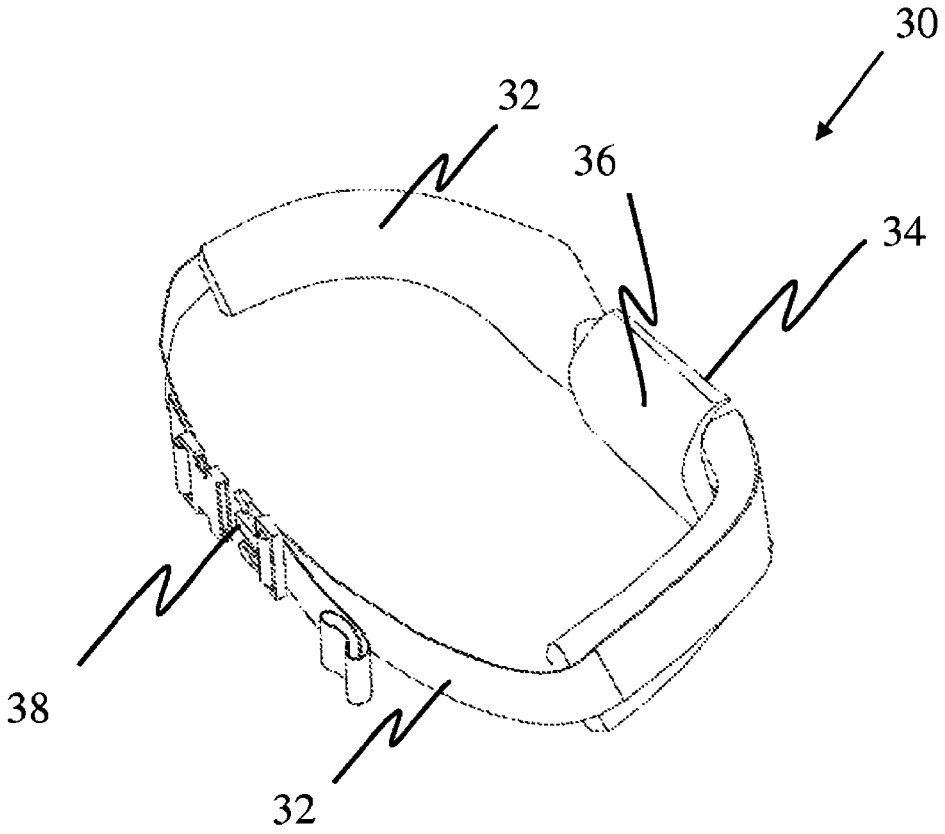
PRIOR ART Figure 3A
Figure 3B:
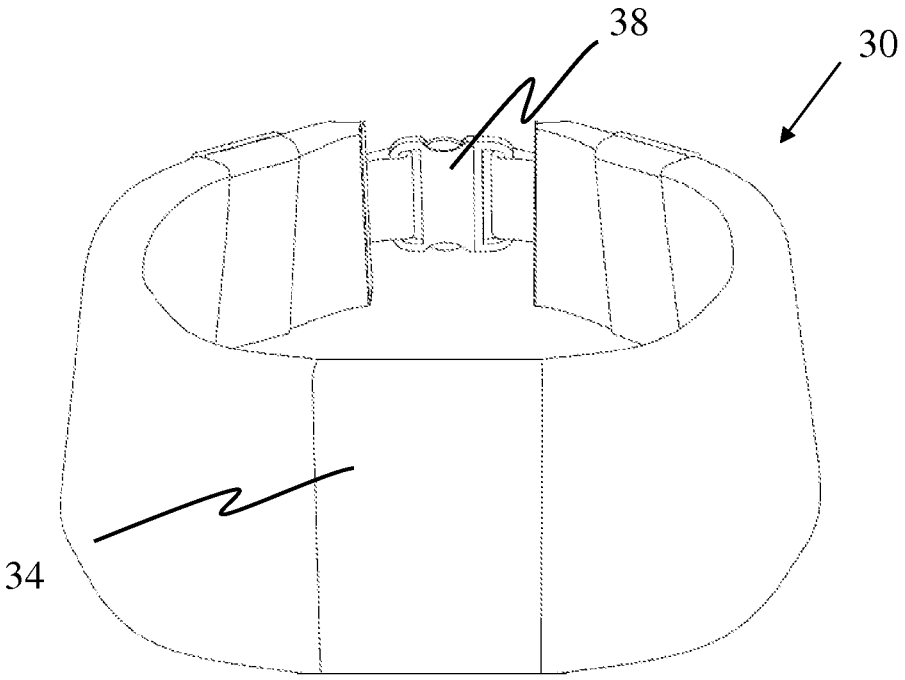
PRIOR ART Figure 3B

FIGS. 3A and 3B illustrate a front view and a back view of a prior art lumbar belt 30 for coupling with a prior art harness. The belt 30 includes a strap 32, a back side having cushioning (will be referred to herein as "back cushioning") that includes an internal part 36 and an external part 34, and a buckle 38 serving as fastening means. Lumbar belt 30 is configured to be wrapped around a user's waist such that the internal part of the back cushioning 36 facing a user (not shown) clings to the lower back of the user, the external part of the back cushioning 34 is attached to a load (not shown), the strap 32 is wrapped around the user's waist and the buckle 38 is fastened in front of the user's abdomen. This is demonstrated in FIGS. 2A and 2B.

Lumbar belts assist in bringing part of a load coupled to a harness close to a user's hips. The fastening and tightening of a load to a user's waist assists in creating a more even and stable distribution of the weight of the load, and shifting some of the weight from the user's shoulders to the user's hips.

Figure 4A:
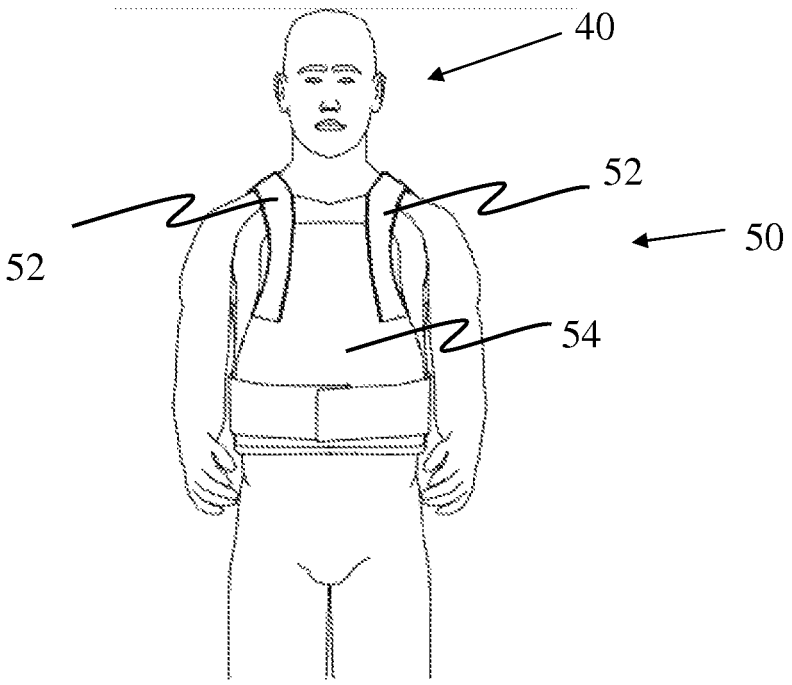
Figure 4B:
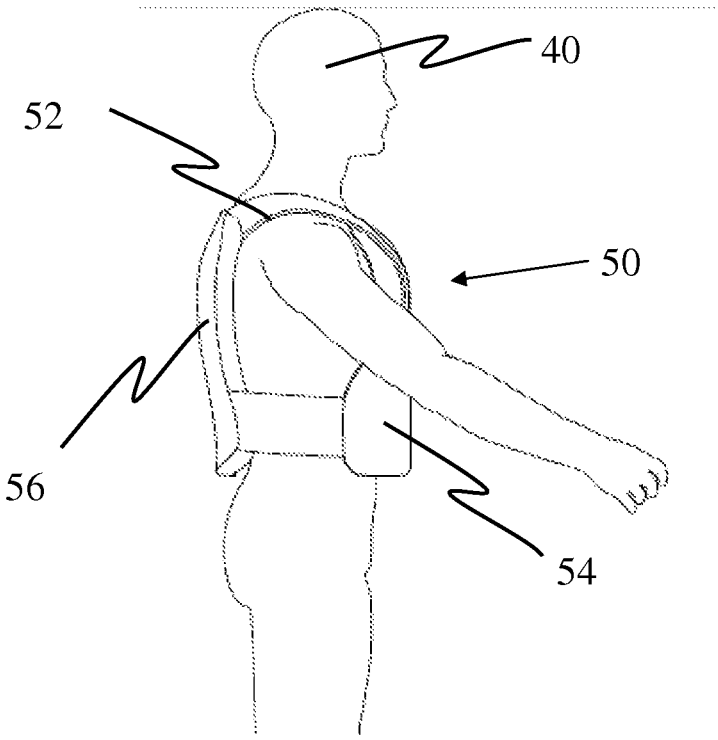

Reference is now made to FIGS. 4A and 4B showing a front view and a side view respectively of a person 40 wearing a bullet resistant vest 50. The bullet resistant vest 50 typically includes shoulder straps 52, a front 54, and a back 56. The vest 50 is typically worn over a user's torso such that the front of the vest 54 is placed against the chest and abdomen of a user 40, the back of the vest 56 covers the back of the user 40, and the shoulder straps 52 are used to hold the bullet resistant vest over the user's torso. The back of the vest 56 includes an interior side facing the user and an exterior side facing away from the user.

Figure 5A:
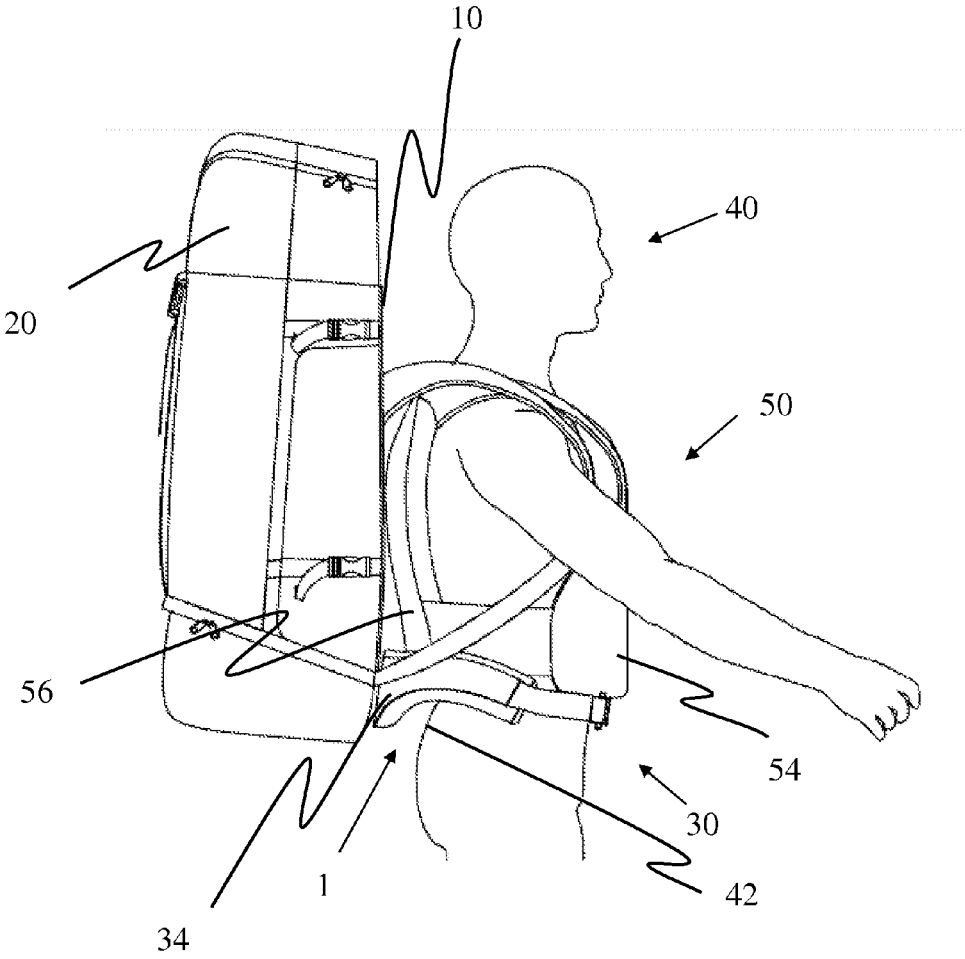
PRIOR ART Figure 5A
Figure 5B:
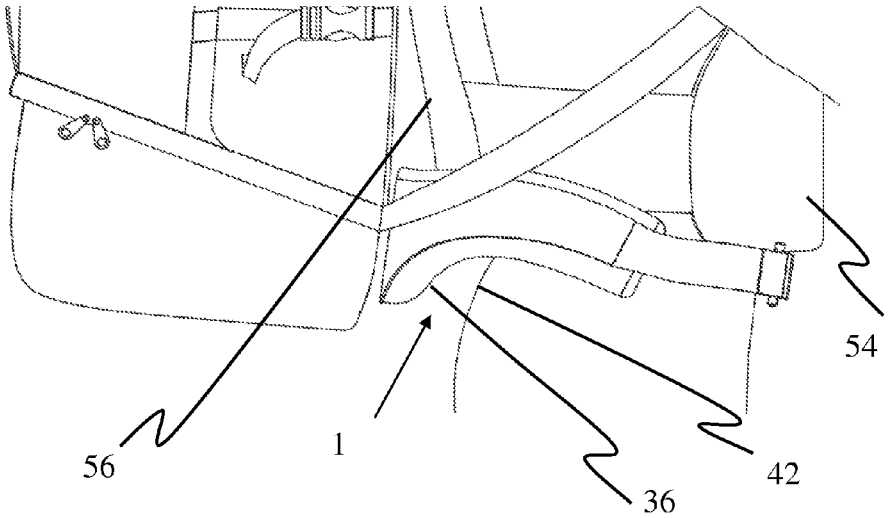
PRIOR ART Figure 5B

Reference is now made to FIG. 5A showing a side view of a user 40 carrying a load 20 assembled on a prior art harness 10 over a bullet resistant vest 50. A bullet resistant vest 50 is usually thicker than typical garments used for clothing and significantly heavier than standard vests. Because the vest is thick, a gap 1 is typically formed between the back side of the user's waist 42 and the interior side of the lumbar belt 30. This is demonstrated in FIG. 5B. As a result of the gap, the lumbar belt 30 might tend to become ineffective as a support element for distributing the weight of the load 20 across the user's back and transferring the weight to the hips.

Distributing Weight Carried Over a Vest

A bridging device for distributing weight of loads carried over bullet resistant gear comprises a first axle configured to couple with a frame of a harness or directly with a load, a second axle configured to couple with a back side of a support element such as a lumbar belt, and at least one adjustable connecting element between the first and the second axle. The connecting element must be long enough to bridge the gap formed between the support element and the harness or load when the latter is carried by a user on top of a thick and/or rigid vest. The connecting element is typically capable of maintaining a tension between the load and the support element so that the harness or load remains steady upon the user.

A perspective view of an embodiment 100 of the bridging device is shown in FIG. 6A. The embodiment 100 comprises a first axle 162 configured to couple with a frame of a harness or directly with a load, a second axle 164 configured to couple with a back side of a support element such as a lumbar belt, and two adjustable connecting elements 170 between the first and the second axles, each connecting the first axle 162 to the second axle 164.

Axles are typically made of a rigid material, for example and without limitation metal, wood, plastic, composite materials or combinations thereof. The connecting element may be made of material capable of folding, and yet also capable of maintaining a tension between the first and the second axle, for example and without limitation a thin layer of metal, plastic, elastic fabric or the like. Alternatively, the connecting element may be stiff yet the axles may nevertheless allow the user to easily bend even when carrying a heavy load over a thick vest, while maintaining the steadiness of the load on the user 40.

FIG. 6B illustrates a second embodiment 200 of the bridging device for distributing weight of loads carried over bullet resistant gear. In this embodiment, the adjustable connecting element 270 comprises a first metallic plate 272 connected to the first axle 262, a second metallic plate 274 connected to the second axle 264, and a middle axle 276 connected to the first and second metallic plates 272 and 274. The extra axle 276 gives the device a flexibility even when the materials are very rigid, yet allows maintaining tension between the load and the and the support element even during movement of the user.

Figure 7:
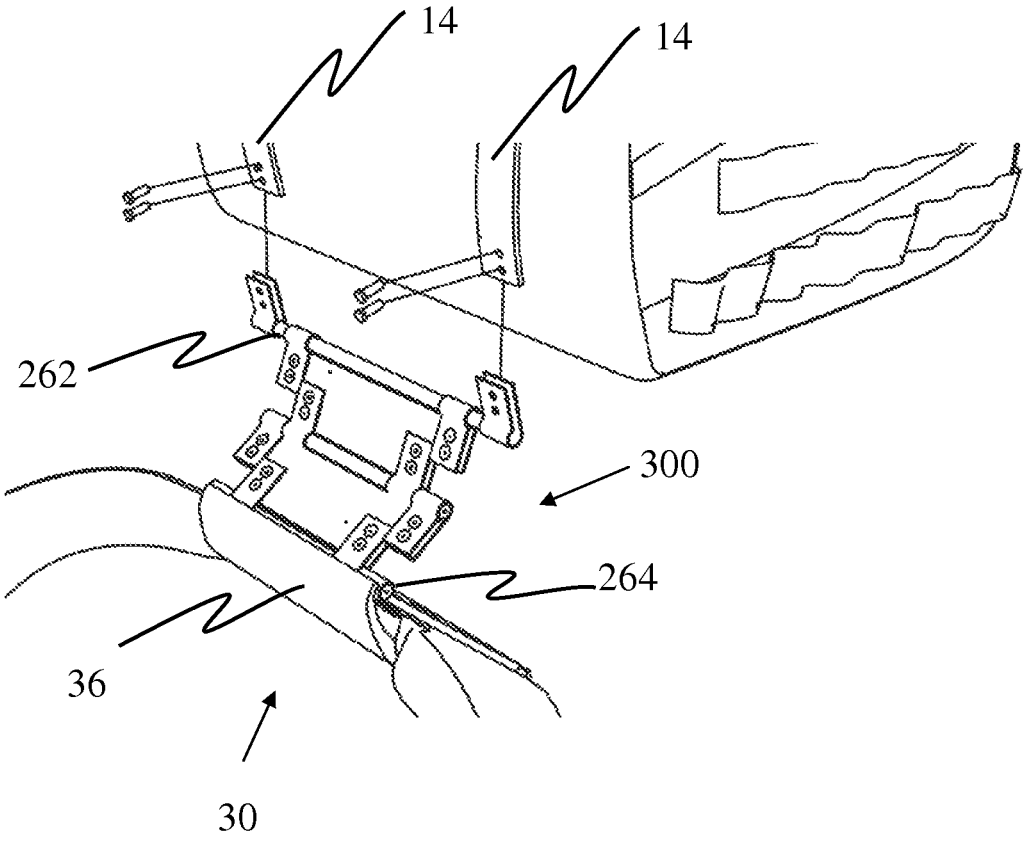

Reference is now made to FIG. 7 illustrating an embodiment of the bridging device 300 coupled with a harness 10 and a lumbar belt 30. The bridging device 300 is configured to be attached to a frame 14 of a harness 10 on one end, and to the exterior (not shown) of a back cushioning of a lumbar belt 30 on its other end. It is to be understood that the lumbar belt 30 depicted in FIGS. 3A and 3B is for illustration purposes only. The device may be used with different weight-support elements, such as lumbar belts and security straps such as but not limited to chest straps, and combinations thereof.

Embodiments of the bridging device are configured to bridge across the gap (1 in FIG. 5) formed between a support element and the frame of a harness when the user is wearing the harness over a thick vest such as a bullet resistant vest. Alternatively, the embodiments may be viewed as allowing fastening of a support element to a user, when the support element is coupled to harness over a vest.

Referring now to FIG. 8, a placing of a bridging device 400 is shown. The figure schematically illustrates essential elements which demonstrate use of a bridging device 400. The bridging device 400 is shown coupled to a frame 14 of a harness on one end, and to a lumbar belt 30 serving as a support element on the other end. The user 40 is able to attach the lumbar belt 30 to his waist even when the harness is worn over a backside 56 of a thick vest.

According to preferred embodiments, in using the bridging device 400 and some other embodiments, the user 40 may insert at least part of the support element (for example at least part of the back side of the lumbar belt 30) between the user and the vest, thus contributing to general comfort and stability when carrying a heavy load.

In a further preferred embodiment, part of the bridging element is inserted between the support element and the vest.

FIG. 9A illustrates bridging device 100 shown in FIG. 6A, and in addition a plate 80 serving as connecting means for coupling the bridging device 100 to a support element such as a lumbar belt. FIG. 9B illustrates a coupling of another embodiment, bridging device 500, to a frame 14 of a harness. FIG. 10A illustrates bridging device 300 and a plate 80, and FIG. 10B illustrates another view of coupling bridging device 200 to a frame 14 of a harness.

FIG. 11A illustrates the coupling of an embodiment of a bridging device 500 to a lumbar belt 30 wherein the coupling comprises inserting the plate (not shown) into the lumbar belt 30. FIG. 11B illustrates the coupling of an embodiment of the bridging device 100 to a lumbar belt 30 on one end by attaching the plate 80 to the lumbar belt 30, and coupling the bridging device 100 to a harness 10 on the other end. The figure shows that bridging device 100 can be extended to bridge a gap between the lumbar belt 30 and the harness 10.

When a load is carried by a user over a bullet resistant vest, the back of the vest (56 in FIG. 4B) comprises an interior side facing the user and an exterior side facing away from the user. The first axle couples with the harness or directly with the load in the area proximal to the exterior side of the vest's back (56 in FIG. 4B). The second axle couples with the support element in the area proximal to the interior side of the vest's back (56 in FIG. 4B). For example, the second axle may couple to the back cushioning 34 of a lumbar belt (FIGS. 3A and 3B). Preferably, at least part of the lumbar belt can be secured between the user and the interior side of the vest to further contribute to stable harnessing of a harness upon a user when the user is standing up, moving about, bending forward or such like actions.

Embodiments of a bridging device may be provided as independent pieces, configured to be coupleable with for example loads, and/or standard harnesses, and/or commercially available support elements such as ordinary lumbar belts. Such embodiments may be used for retrofitting a bridging device to standard equipment. Additionally and alternatively, dedicated harnesses, loads and/or support elements may be provided with coupling utilities for coupling with a bridging device. Such coupling utilities may include for example and without limitation pins, magnets, buttons, ropes, apertures, snap fits, and combinations thereof.

Additionally and alternatively, embodiments may be provided in an integrated form, optionally with at least one support element and at least one harness. Integration between a bridging device and a harness may be achieved for example by way of soldering, sewing or the like. Integrated embodiments may contain for example and without limitation:

- a bridging device integrated with a support element such as a lumbar belt on one end and capable of coupling with a harness or a load on the other end;
- a bridging device integrated with a harness on one end and capable of coupling with a support element such as a lumbar belt on the other end; or
- a bridging device integrated with a both harness on one end and a support element such as a lumbar belt on the other end.

In some embodiments, a locking mechanism for eliminating the effect of the bridging device may be provided. Eliminating the effect of the bridging device may be useful in cases where a user intends to carry loads in a plurality of situations, some of which do not require use of the device.

The locking mechanism for elimination of the bridging effect may comprise for example and without limitation a coupling utility for attaching the first axle to the second axle. Attaching the axles to each other eliminates the bridging effect of the connecting element. Such a coupling utility may include for example and without limitation pins, magnets, buttons, ropes, apertures, snap fits, and combinations thereof.

Additionally and alternatively, the locking mechanism may be combined with the connecting element. For example, the connecting element may comprise linked joints and a spring mechanism used to control expansion and constriction of the links. The linked joints in their expanded state may be used to create the bridging effect, and the spring mechanism for constricting the linked joints may be used to constrict the connecting element and bring the first and the second axle close together, thus eliminating the bridging effect.

The figures shown hereinabove illustrate embodiments of a bridging device wherein axles are made of a rigid material. Alternatively, the entire device may be made of a flexible material such as strong fabric, capable of pivoting around a virtual axle formed around the two connection points, for example:

- between the device and the support element on one end; and
- between the device and the frame of a harness on the other end.

Coupling the device to the support element and to the frame of a harness can be done by using various means such as but not limited to glues and pins, and by using different methods such as soldering or sewing.

In various embodiments, axles for connecting the bridging device to the harness and to the support element are fixed. Fixed axles (not shown) do not enable a pivoting movement of connecting elements around them. Such connecting elements for connecting the first axle to the second axle and creating the bridging effect may be made of a rigid material, and not capable of bending and folding.

Reference is now made to FIG. 12, showing an embodiment of a bridging device 600. In this embodiment axles are fixed, and used only for integration of the bridging device 600 with the harness 610 and the lumbar belt 630.

The figure illustrates a pin 3 used for integrating the harness 610 with the first axle (not shown). Other means and methods of integration may be used for integration, for example and without limitation soldering the harness to the bridging device. The figure further illustrates plate 680 integrated with the back side 634 of the lumbar belt 630. In this embodiment, integration is achieved by sewing the back side 634 to the plate 680, but other embodiments may use any other integration means which suit requirements.

Embodiments with fixed axles comprise a gap 2 between the harness 610 and the back side of the lumbar belt 634, where a vest (not shown) can be inserted. In this figure, the gap is formed over the bridging device 600, between the plate 680 integrated with the lumbar belt 630 and the harness 610.

Reference is now made to FIG. 13 showing an embodiment of a bridging device 700 having a plate 780 and connecting elements 770 made from a rigid material. The device 700 is integrated with a harness 710 via a fixed first axle 762. Plate 780 comprises coupling means for retrofitting with standard support elements such as lumbar belt 30 in FIGS. 3A and 3B. A method is taught for distributing a weight of a load carried by a user also wearing a thick vest such as a bullet resistant vest. The method will be demonstrated through a specific embodiment of the bridging device, wherein the device is integrated with a harness on one end, and with a lumbar belt acting as a support element on the other end. The user may first wear the thick vest. Then, the user may put on the harness coupled with the load upon his shoulders for example by using shoulder straps. The user preferably places at least the uppermost part of the lumbar belt's back cushioning between his torso and the vest, and fastens the lumbar belt around his waist, thus attaching the harness coupled with the load to the vest and to the hips.

Additionally and alternatively, when using a non-integrated embodiment of the bridging device, the method may further comprise attaching the bridging device to at least one support element such as chest straps or a lumbar belt. Embodiments may be used with various types of support elements such as but not limited to lumbar belts, chest straps, abdominal straps, or the like. The bridging assists in securing at least part of the support element between a user's back and a vest acting as a first layer of gear.

Reference is made to FIG. 14 demonstrating usage of a bridging device embodiment for distributing weight by a person bending forward. Person 40 is harnessed with a load 20 assembled upon a back support system 10 having a lumbar belt 30 and embodiment of bridging device 200 coupling lumbar belt 30 to back support system 10, essentially as shown in FIG. 11B. In this Figure, back support system 10 is assembled directly on the back of person 40. Bridging device 200 is shown in its fully extended form, maintaining tension between lumbar belt 30 and back support system 10.

In its extended form, bridging device 200 enables an extension of back support system 10 relative to the positioning of lumbar belt 30, an extension which enables user 40 to bend forward freely. The relative movement of the upper body part harnessed with back support system 10 can be performed independently, without being affected by the waist harnessed with lumbar belt 30.

The extension of bridging device embodiment 200 is automatic according to the extent of the bending movement performed by user 40. Automatic extension eliminates the need to adjust the back support system according to the personal characteristics of the user, and ensures that the lumbar belt remains in its optimal position on the user's waist and hips regardless of the movement of the user's upper body part.

Specifically, with the extendible bridging device 200 the distance between the lumbar belt and the base of the shoulder straps is automatically adjusted, without a need for the user to perform a specific operation to enable the adjustment.

The scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

What is claimed:

1. A system comprising:

a harness: an extendible bridging device, coupling the harness to a support element, the bridging device comprising:

a first axle attached to a frame of the harness;

a first plate connected to the first axle;

a second axle attached to the support element and extending parallel to the first axle;

a second plate connected to the second axle, and a middle axle connected to the first plate and the second plate and extending parallel to the first axle and the second axle, wherein only the first axle is attached to the frame of the harness; and a vest having an interior side and an exterior side; wherein the harness is proximal to the exterior side of the vest, and the system is configured to enable the insertion of at least part of said bridging device between the support element and the interior side, and wherein the bridging device, in its fully extendible form, is capable of maintaining a tension between the harness and the support element.

2. The system of claim 1, wherein the bridging device further comprises a plate having an end coupled to said second axle wherein said plate is capable of being coupled to said support element.

3. The system of claim 1, wherein the bridging device further comprises a locking mechanism capable of coupling said first axle to said second axle.

4. The system of claim 1, wherein said support element is capable of being fastened to at least part of a torso of the user.

5. The system of claim 1, wherein said support element is selected from a group comprising belts, straps, bands, and combinations thereof.

6. The system of claim 1, wherein the bridging device is configured to retrofit with said support element.

7. The system of claim 1, wherein the bridging device is configured to retrofit with the load.

8. The system of claim 1, wherein the bridging device is configured to retrofit with the harness.

9. The system of claim 1, wherein the bridging device is integrated with said support element.

10. The system of claim 1, wherein said first axle is capable of being coupled to the harness.

11. The system of claim 1, wherein the bridging device is integrated with the harness.

12. The system of claim 1, wherein said bridging device is automatically extendible.

13. An extensible bridging device, for coupling a harness capable of receiving a load to a support element, and a vest wearable by a user thereof, said bridging device comprising:

a first axle attached to a frame of the harness;

a first plate connected to the first axle;

a second axle attached to the support element and extending parallel to the first axle;

a second plate connected to the second axle, and a middle axle connected to the first plate and the second plate and extending parallel to the first axle and the second axle, wherein only the first axle is attached to the frame of the harness;

wherein at least part of said bridging device is insertable between the support element and the vest, and wherein the bridging device in its fully extendible form, is capable of maintaining a tension between the harness and the support element.

14. A system comprising:

a harness: an extendible bridging device, coupling the harness to a support element, the bridging device consisting of:

a first axle attached to a frame of the harness;

a first plate connected to the first axle;

a second axle attached to the support element;

a second plate connected to the second axle, and a middle axle connected to the first plate and the second plate, wherein only the first axle is attached to the frame of the harness; and a vest having an interior side and an exterior side; wherein the harness is proximal to the exterior side of the vest, and the system is configured to enable the insertion of at least part of said bridging device between the support element and the interior side, wherein the bridging device, in its fully extendible form, is capable of maintaining a tension between the harness and the support element.

15. An extensible bridging device for coupling a harness capable of receiving a load to a support element, and a vest wearable by a user thereof, said bridging device consisting of:

a first axle attached to a frame of the harness;

a first plate connected to the first axle;

a second axle attached to the support element;

a second plate connected to the second axle, and a middle axle connected to the first plate and the second plate, wherein only the first axle is attached to the frame of the harness, and wherein at least a part of the bridging device is insertable between the support element and the vest, and wherein the bridging device in its fully extendible form, is capable of maintaining a tension between the harness and the support element.

* * * * *